United States Patent [19]

Nakanishi et al.

[11] 4,389,306

[45] Jun. 21, 1983

[54] PROCESS FOR REMOVING ASH FROM COAL

[75] Inventors: Takeshi Nakanishi; Kazuo Harada; Nobuyuki Yoshida; Etsuo Ogino, all of Osaka, Japan

[73] Assignee: Hitachi Shipbuilding & Engineering Co., Ltd., Osaka, Japan

[21] Appl. No.: 305,157

[22] Filed: Sep. 24, 1981

[30] Foreign Application Priority Data

Oct. 8, 1980 [JP] Japan ..... 55-141504
Oct. 8, 1980 [JP] Japan ..... 55-141505
Oct. 8, 1980 [JP] Japan ..... 55-141506

[51] Int. Cl.[3] ..... B03B 1/00
[52] U.S. Cl. ..... 209/5; 210/714; 210/713; 44/24
[58] Field of Search ..... 209/5, 3; 44/15 A, 24, 44/25; 210/704, 714, 728, 729, 713

[56] References Cited

U.S. PATENT DOCUMENTS 3,458,044 7/1969 Moss et al. ..... 210/704
4,021,206 5/1977 Huberts et al. ..... 44/24
4,138,226 2/1979 Verschuur ..... 44/24
4,255,155 3/1981 Frankovich ..... 44/24

FOREIGN PATENT DOCUMENTS 903853 8/1962 United Kingdom ..... 209/5

*Primary Examiner*—Bernard Nozick
*Attorney, Agent, or Firm*—Allison C. Collard; Thomas M. Galgano

[57] ABSTRACT

A process for removing ash from coal comprising the steps of pulverizing the coal to fine particles, admixing water with the finely divided coal to prepare an ash-containing slurry of finely divided coal, mixing with the slurry an oil and seeds in the form of oleophilic solid grains and serving as granulating nuclei to granulate the finely divided coal, separating the resulting granules from the mixture and washing the granules with water to remove the ash, and disintegrating the washed granules to obtain a deashed coal and recover the seeds for reuse.

8 Claims, 3 Drawing Figures

PROCESS FOR REMOVING ASH FROM COAL

BACKGROUND OF THE INVENTION

This invention relates to a process for treating ash-containing coal to remove the ash therefrom.

Naturally occurring coals have relatively high ash contents. Usually coal contains about 7 to about 25% of ash which consists chiefly of silica ($SiO_2$), alumina ($Al_2O_3$), etc. When observed by an X-ray microanalyzer, the ash in coal is in the form of particles about 5 μm to tens of μm in size. It is already known to remove such ash from coal by pulverizing the coal, mixing the pulverized coal with water to obtain a slurry, adding to the slurry an oil serving as a binder to form the coal and the oil into granules, and separating the granules from the ash-containing aqueous medium. The granules separated from the ash are pellets of oil-containing deashed coal useful as a fuel. However, the conventional process has the problem of being unable to fully remove the ash from coal, because for the full removal of the ash, the coal must be pulverized to very fine particles as small as ash particles contained therein, i.e. about 5 μm to tens of μm. Nevertheless, if coal is divided exceedingly finely, the particulate coal has an increased surface area, requires the use of an increased amount of the binder oil and takes a greatly prolonged period of time for granulation. Consequently it is impossible to pulverize coal to very fine particles and therefore to deash the coal to a full extent.

SUMMARY OF THE INVENTION

The present invention provides a process for removing ash from coal free of the foregoing problems. According to this invention, ash-containing coal is pulverized to very fine particles, which are granulated with use of seeds in the form of oleophilic solid grains. The coal particles can therefore be granulated with use of a greatly reduced amount of oil within a short period of time. Since only a small amount of ash is incorporated into the granules during the granulation step, the present process affords deashed coal having a very low ash content. The deashed coal can be obtained in the form of an oil-containing deashed coal or coal-oil mixture. Accordingly when the deashed coal, oil-containing coal or coal-oil mixture prepared by the process of the invention is used as a fuel, the coal burns easily with stability, gives off an increased amount of heat per unit quantity and produces only a greatly reduced amount of ash.

The invention will be described below with reference to the accompanying drawings.

DESCRIPTION OF THE PREFERRED EMBODIMENTS

Figure 1:
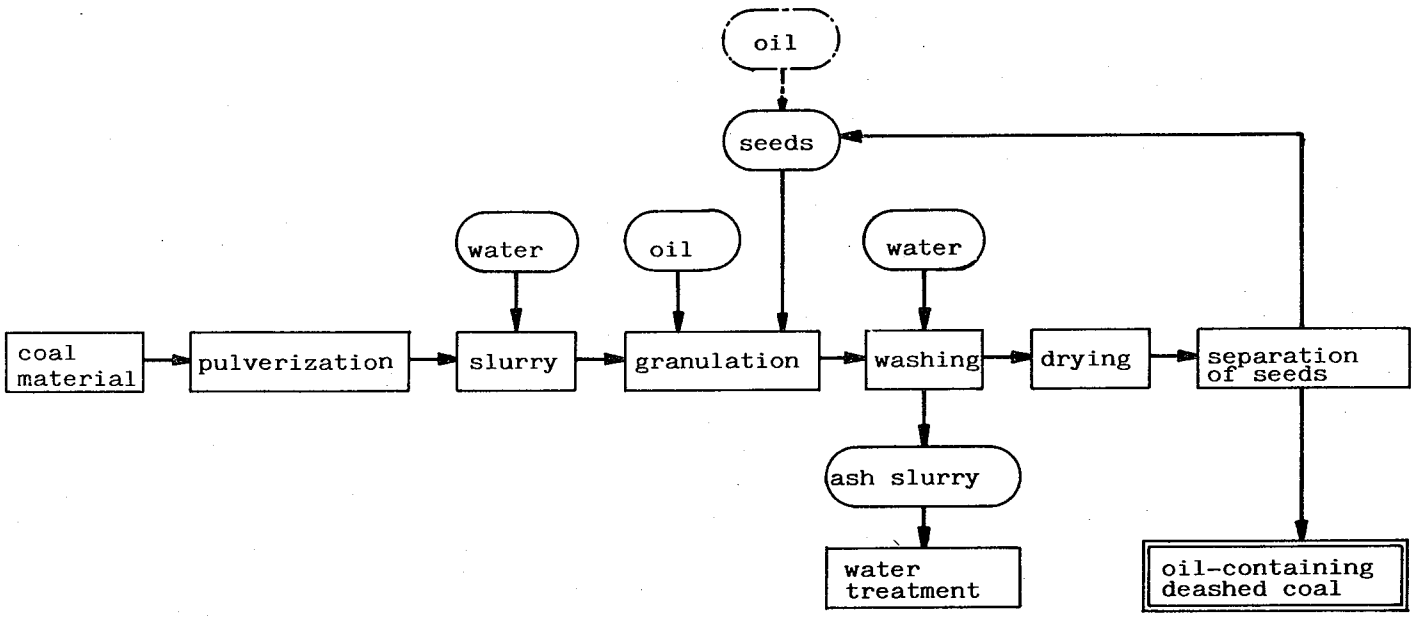
FIG. 1 is a block diagram showing a first embodiment of the invention, i.e. a process for preparing oil-containing deashed coal.

With reference to FIG. 1 showing a first embodiment of the invention, ash-containing coal material is deashed by the following four steps to afford oil-containing deashed coal.

(1) Preparation of finely divided coal slurry

Naturally occurring ash-containing coal is pulverized, for example, by a wet-type ball mill to fine particles of hundreds of μm to tens of μm in size. While the coal material usually contains 7 to 25% by weight of ash, the ash is also finely divided by pulverization. The finely divided ash-containing coal is then mixed with water to obtain a coal slurry. When desired, the coal may be pulverized to superfine particles of several μm. Preferably the coal material is pulverized in water, and a required quantity of water is added to the resulting slurry for the adjustment of the concentration.

(2) Granulation

An oil and seeds in the form of oleophilic solid grains and serving as granulating nuclei are admixed with the finely divided coal slurry for granulation. Examples of useful oils are kerosene, gas oil, fuel oil, residuum oil, vegetable oils, etc. The oil is used, for example, in an amount of about 10 to about 30% by weight based on the coal. To render the oil easily dispersible in the slurry, a small amount of surfactant may be used. The seeds serving as granulating nuclei must be oleophilic and must be in the form of solid grains so as to be recoverable with ease later. Preferably, the seeds have a specific gravity approximate to that of coal, i.e. to 1.4. Examples of useful seeds are granules or grains of synthetic resin, such as rigid polyvinyl chloride, coarse coal grains, etc. which are about 1 to 10 mm in size. Seeds larger than 10 mm in grain size are not desirable since ash particles will easily adhere to such seeds along with coal particles. Preferably the seed to coal ratio is usually 1:1. This ratio is of course slightly variable provided that the combined amount of the seeds and the finely divided coal is up to 30% by weight based on the combined amount of the seeds and the slurry.

The oil and seeds are admixed with the coal slurry by one of the following three methods.

(1) The seeds are admixed with the coal slurry, and the oil is then admixed with the resulting mixture.

(2) The oil is added to the seeds to apply the oil to the surfaces of the seeds, and the seeds are then admixed with the coal slurry.

(3) The oil is admixed with the coal slurry, and the seeds are thereafter admixed with the resulting mixture.

The mixture thus prepared is agitated for granulation with use of a granulating apparatus having stirring blades of metal net or other known granulating machine. In this step, the oil adheres to the surfaces of the seeds in the form of oleophilic solid grains, and fine coal particles adhere in increasing amounts to the oil coating the seeds serving as nuclei, whereby the fine coal particles are clustered and formed into granules very rapidly in an accelerated fashion. Accordingly the particulate coal is granulated within an extremely short period of time. Furthermore the use of the seeds greatly reduces the amount of oil to be used. On the other hand, the ash pulverized approximately to the same size as the coal particles remains in the water.

When the coal material contains a large amount, e.g. about 20% by weight, of ash, the mixture may be subjected to a primary deashing treatment prior to the granulation. More specifically, when the seeds and oil are admixed with the finely divided coal slurry, the resulting mixture separates into a liquid phase containing the particulate coal, seeds and oil, and a slurry in the form of ash-containing water. The ash-containing slurry is separated off from the coal-containing liquid phase, and the liquid phase is washed with fresh water, whereby a considerable amount of ash is removed.

(3) Washing

The granules composed of the finely divided coal, oil and seeds are then separated from the resulting mixture and washed to remove the ash. This step is performed, for example, by passing the mixture over a filter while spraying washing water from above. When desired, the separated granules are centrifuged to remove water to a greater extent. The granules composed of the finely divided coal, oil and seeds and washed are dried to completely remove water. The ash-containing slurry fraction is led into a water treating apparatus equipped with a thickener, filter, etc. is thereby separated into the ash and water.

(4) Separation of seeds

The dried granules are disintegrated, for example, by vibration and thereby separated into the seeds and oil-containing deashed coal in the form of pellets to obtain the deashed coal and to recover the seeds for reuse in the second step of granulation. The seeds, bearing some amount of oil, may be returned to the granulation step directly or with further application of oil.

The oil-containing deashed coal thus prepared has been fully deashed and is effectively usable as a fuel.

Figure 2:
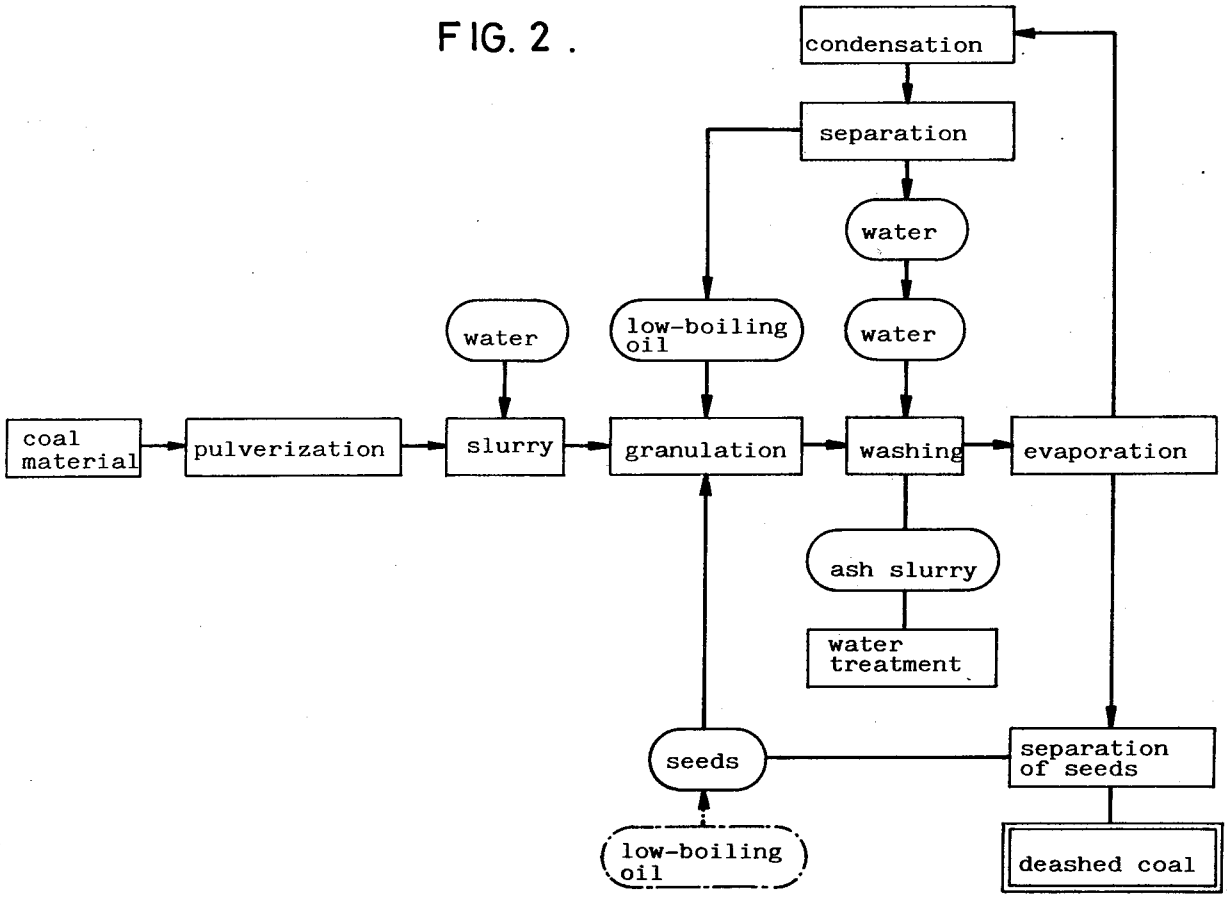
FIG. 2 is a block diagram showing a second embodiment of the invention, i.e. a process for preparing deashed coal.

With reference to FIG. 2 showing a second embodiment of the invention, an ash-containing coal material is deashed by the following six steps to afford a deashed coal.

(1) Preparation of finely divided coal slurry

A slurry of finely divided coal is prepared in the same manner as in the first embodiment.

(2) Granulation

A low-boiling oil and seeds in the form of oleophilic solid grains and serving as granulating nuclei are admixed with the finely divided coal slurry for granulation. Useful low-boiling oils are those small in latent heat of vaporization and low in viscosity, such as kerosene, gas oil, gasoline, etc. The low-boiling oil is used, for example, in an amount of about 10 to about 30% by weight based on the finely divided coal. A small amount of surfactant may be used conjointly to render the oil dispersible in the slurry easily. The same seeds as used for the first embodiment are used as granulating nuclei. The coal slurry, low-boiling oil and seeds are mixed together in the same manner as in the first embodiment for granulation.

(3) Washing

The granules formed are washed in the same manner as in the first embodiment.

(4) Heating for evaporation

The granules washed and composed of the finely divided coal, low-boiling oil and seeds are heated to evaporate the oil and water. Steam or electric heat is used as the heat source.

(5) Separation of seeds

The dried granules free from the low-boiling oil are disintegrated, for example, by vibration and thereby separated into the seeds and deashed coal in the form of pellets to obtain the deashed coal and to recover the seeds for reuse in the second step of granulation. The seeds may be returned to the granulation step with or without the low-boiling oil applied thereto.

(6) Condensation and separation

The evaporated gaseous mixture of the low-boiling oil and water is subjected to condensation and thereafter separated into liquid low-boiling oil and water. The liquid low-boiling oil is returned to the granulation step.

The deashed coal thus prepared has been fully deashed and is effectively usable as a fuel.

Figure 3:
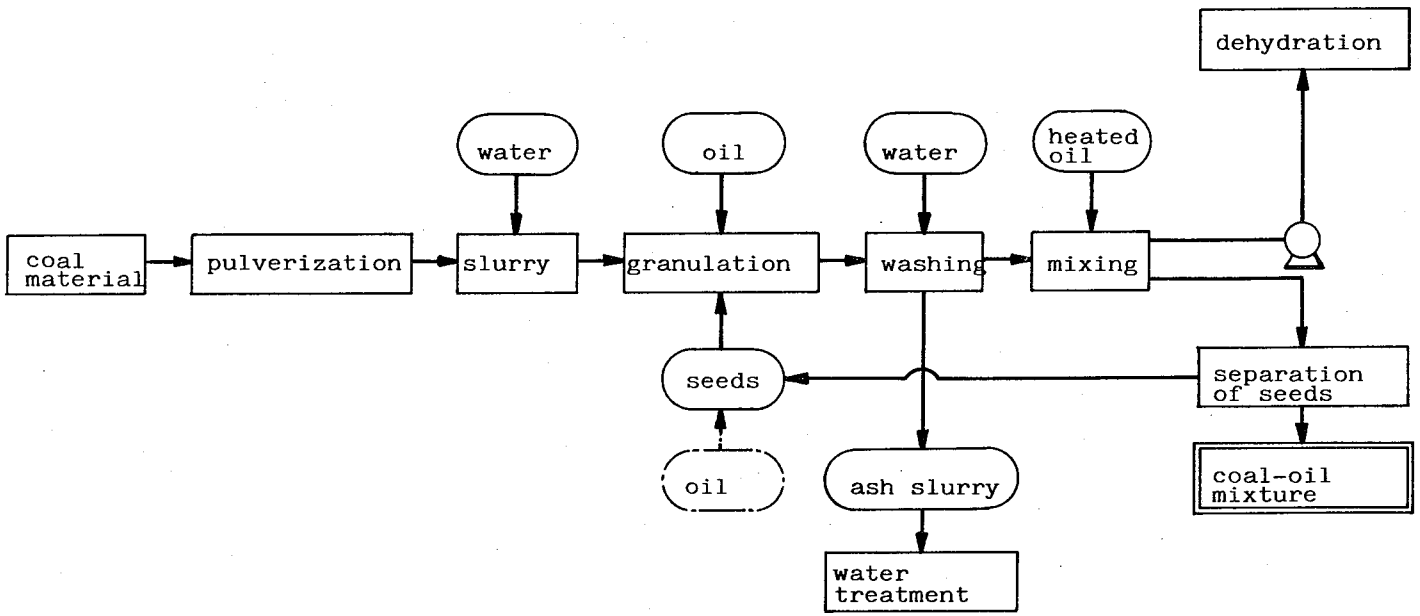
FIG. 3 is a block diagram showing a third embodiment of the invention, i.e. a process for preparing a coal-oil mixture.

With reference to FIG. 3 showing a third embodiment of the invention, an ash-containing coal material is deashed by the following five steps to afford a coal-oil mixture.

(1) Preparation of finely divided coal slurry (2) Granulation (3) Washing

These three steps are conducted in the same manner as in the first embodiment.

(4) Mixing of heated oil

An oil heated to 70° to 150° C. is admixed with the granules washed and composed of the finely divided coal, oil and seeds, and the mixture is subjected to suction to cause water to evaporate off. Examples of oils useful for this step are fuel oil, residuum oil, etc. having a relatively high boiling point. When kerosene, gas oil or like low-boiling oil is used as the oil for the granulation step, the oil will be partly evaporated off by the suction along with water. When desired, the evaporated gaseous mixture of such low-boiling oil and water may be cooled for condensation to separate the low-boiling oil in a liquid state from the water for recovery. The recovered oil is then returned to the granulation step for reuse. The heated oil is used in such an amount that the coal to oil ratio of the coal-oil mixture eventually obtained will be, for example, 1:1. Since up to 30% by weight of oil is added to the slurry in the granulation step, at least 70% by weight of the heated oil is used based on the finely divided coal so that the combined amount of the oils will be approximately equal to the amount of the finely divided coal. When the coal to oil ratio of the coal-oil mixture is to be varied, the amount of the heated oil is suitably varied accordingly.

(5) Separation of seeds

The granules containing the heated oil are disintegrated and are thereby separated into the seeds and a mixture of deashed coal and oil to obtain the mixture and to recover the seeds for reuse in the second step of granulation. The seeds, bearing a small amount of oil, is returned to the granulation step with or without oil further added thereto.

The coal-oil mixture thus obtained contains fully deashed coal and is therefore advantageously usable as a fuel.

The present invention will be described with reference to the following examples, to which the invention is not limited.

EXAMPLE 1

An oil-containing deashed coal was prepared by the process shown in FIG. 1. Blair Athol coal (occurring in Australia) having an ash content of 7.02% by weight was pulverized to fine particles not larger than 200 mesh, i.e. up to 74 μm, in size. The finely divided coal was mixed with water to obtain a coal slurry. Seeds were then admixed with the coal slurry. The seeds were made of rigid polyvinyl chloride, were in the form of short cylinders about 3 mm in diameter and about 1.5 mm in height, and had a specific gravity of 1.4 approximate to that of the coal. The mixture contained 5% by weight of the coal and 5% by weight of the seeding material. Subsequently kerosene was admixed with the mixture in an amount of 20% by weight based on the finely divided coal. The resulting mixture was fed to a granulating machine for granulation. The granules were separated from the aqueous phase and washed with water to remove the ash. The granules were then dried and disintegrated by vibration to obtain an oil-containing deashed coal in the form of pellets. The seeds separated from the coal were recovered and returned to the granulation step for reuse. To determine the ash content of the oil-containing deashed coal thus prepared, the oil was extracted from the coal with a solvent. The resulting coal was found to contain only 1.74% by weight of ash. For comparison, the same coal material as used above was deashed by the conventional process without using any seed. The oil-containing deashed coal obtained was found to contain 3.32% by weight of ash based on the finely divided coal. The results are listed in the table given later.

EXAMPLE 2

An oil-containing deashed coal was prepared from Daido coal (occurring in China) containing 12.14% by weight of ash in the same manner as in Example 1 except that seeds of rigid polyvinyl chloride to which kerosene was applied were admixed with a slurry of finely divided coal. The oil-containing deashed coal obtained was found to have the ash content listed below. The table also shows the result achieved by the conventional process with use of the same coal material. The ash contents listed are based on the coal free from the oil.

EXAMPLE 3

An oil-containing deashed coal was prepared from the same Daido coal as used in Example 2 in the same manner as in Example 1 with the exception of admixing a specified amount of kerosene with a slurry of finely divided coal and thereafter mixing seeds with the mixture. The following table shows the result achieved and also the result attained by the conventional process without using any seed.

| | Ash content of coal (% by weight) | | |
|---|---|---|---|
| Example | Material | Conventional process | Process of invention |
| 1 | 7.02 | 3.32 | 1.74 |
| 2 | 12.14 | 5.58 | 3.17 |
| 3 | 12.14 | 5.58 | 4.78 |

EXAMPLE 4

A deashed coal was prepared by the process shown in FIG. 2. Blair Athol coal (occurring in Australia) having an ash content of 7.02% by weight was pulverized to fine particles not larger than 200 mesh, i.e. up to 74 μm, in size. The finely divided coal was mixed with water to obtain a coal slurry. Seeds were then admixed with the coal slurry. The seeds were made of rigid polyvinyl chloride, were in the form of short cylinders about 3 mm in diameter and about 1.5 mm in height, and had a specific gravity of 1.4 approximate to that of the coal. The mixture contained 5% by weight of the coal and 5% by weight of the seeding material. Subsequently gasoline was admixed with the mixture in an amount of 20% by weight based on the finely divided coal. The resulting mixture was fed to a granulating machine for granulation. The granules were separated from the aqueous phase and washed with water to remove the ash. The granules were then heated to evaporate the gasoline and water. The gasoline-free granules were disintegrated by vibration to obtain a deashed coal in the form of pellets. The seeds thus separated were recovered and returned to the granulation step for reuse. The evaporated gaseous mixture of gasoline and water was subjected to condensation and then separated into liquid gasoline and water. The gasoline was returned to the granulation step for reuse. The deashed coal thus prepared was found to contain only 1.86% by weight of ash. For comparison, the same coal material as used above was deashed by the conventional process without using any seed to prepare a deashed coal, which was found to contain 3.32% by weight of ash.

EXAMPLE 5

A coal-oil mixture was prepared by the process shown in FIG. 3. Blair Athol coal (occurring in Australia) having an ash content of 7.02% by weight was pulverized to fine particles not larger than 200 mesh, i.e. up to 74 μm, in size. The finely divided coal was mixed with water to obtain a coal slurry. Seeds were then mixed with the coal slurry. The seeds were made of rigid polyvinyl chloride, were in the form of short cylinders about 3 mm in diameter and about 1.5 mm in height, and had a specific gravity of 1.4 approximate to that of the coal. The mixture contained 5% by weight of the coal and 5% by weight of the seeding material. Subsequently fuel oil was admixed with the mixture in an amount of 20% by weight based on the finely divided coal. The resulting mixture was fed to a granulating machine. The granules formed were separated from the aqueous phase and washed with water to remove the ash. Bunker fuel heated to about 90° C. was mixed with the granules in an amount of about 80% by weight based on the finely divided coal. The mixture was subjected to suction to evaporate water and a small amount of oil. The oil-containing granules were then disintegrated to separate the granules into the seeds and a mixture of deashed coal and oil in an approximate ratio of 1:1. The seeds were recovered and returned to the granulation step for reuse. To determine the ash content of the deashed coal in the mixture, the oil was extracted from the mixture with a solvent. The deashed coal was found to contain only 1.74% by weight of ash. For comparison, the same coal material as used above was deashed by the conventional process without using any seed. The oil-containing deashed coal obtained was found to contain 3.32% by weight of ash based on the finely divided coal.

What is claimed is:

1. A process for removing ash from coal comprising the steps of pulverizing the coal to fine particles, up to hundreds of micro-meters in size, admixing water with the finely divided coal to obtain an ash-containing slurry of finely divided coal, mixing with the slurry an oil and seeds about 1–10 mm in size in the form of oleophilic solid grains and serving as granulating nuclei to granulate the finely divided coal, separating the resulting granules from the mixture and washing the same with water to remove the ash, disintegrating the washed granules and separating the granules into seeds and an oil-containing deashed coal in the form of pellets to obtain the oil-containing deashed coal and recover the seeds, and reusing the seeds for the granulating step.

2. A process as claimed in claim 1, wherein the said fine particles are of a size up to 74 micrometers.

3. A process as defined in claim 1 wherein the oil to be mixed with the slurry along with the seeds is kerosene, gas oil, fuel oil, residuum oil or vegetable oil.

4. A process as defined in claim 1 further comprising the steps of mixing heated fuel oil or heated residuum oil with the washed granules, drying the resulting mixture by evaporating water therefrom, disintegrating the oil-containing granules and separating the granules into the seeds and a mixture of deashed coal and oil to obtain the coal-oil mixture and recover the seeds, and reusing the seeds for the granulating step.

5. A process for removing ash from coal comprising the steps of mixing with an ash-containing aqueous slurry of finely divided coal up to hundreds of micrometers in size a low-boiling oil selected from among kerosene, gas oil and gasoline and seeds about 1–10 mm in size in the form of oleophilic solid grains and serving as granulating nuclei to granulate the finely divided coal, separating the resulting granules from the mixture and washing the granules with water to remove the ash, heating the washed granules to evaporate the low-boiling oil and water therefrom and dry the granules, disintegrating the oil-free granules and separating the granules into the seeds and a deashed coal in the form of pellets to obtain the deashed coal and recover the seeds, and reusing the seeds for the granulating step.

6. A process as claimed in claim 5, wherein the said fine particles are of a size up to 74 micrometers.

7. A process as defined in claim 5 wherein the evaporated gaseous mixture of low-boiling oil and water resulting from the heating step is subjected to condensation and thereafter separated into the low-boiling oil in a liquid state and water, and the liquid low-boiling oil is reused for the granulating step.

8. A process as defined in claims 1, 3, 4 or 5, wherein the seeds are synthetic resin grains or coarse grains of coal.

* * * * *